United States Patent [19]

Kodera et al.

[11] 4,433,398

[45] Feb. 21, 1984

[54] ULTRASONIC TRANSDUCER

[75] Inventors: Masao Kodera; Shigeyuki Akita, both of Okazaki, Japan

[73] Assignee: Nippon Soken, Inc., Nishio, Japan

[21] Appl. No.: 265,692

[22] Filed: May 20, 1981

[30] Foreign Application Priority Data

Aug. 25, 1980 [JP] Japan ..... 55-120380[U]

[51] Int. Cl.[3] ..... H04R 1/34

[52] U.S. Cl. ..... 367/140; 181/177; 181/400

[58] Field of Search ..... 367/140, 151; 181/152, 181/155, 177, 179, 187, 188, 191, 195, 196, 400

[56] References Cited

U.S. PATENT DOCUMENTS

| | | | |
|---|---|---|---|
| 1,827,955 | 10/1931 | Rodriguez | 181/187 X |
| 2,459,162 | 1/1949 | Hayes | 367/151 X |
| 3,028,752 | 4/1962 | Bacon | 367/151 X |
| 3,046,544 | 7/1962 | Auer, Jr. et al. | 367/151 X |
| 3,109,155 | 10/1963 | Degen | 367/151 X |
| 4,104,610 | 8/1978 | Inoue et al. | 181/195 X |

*Primary Examiner*—Richard A. Farley

*Attorney, Agent, or Firm*—Cushman, Darby & Cushman

[57] ABSTRACT

An ultrasonic transducer which is suited to be placed in the place exposed to water, comprises an ultrasonic vibrator which transmits and receives ultrasonic wave, a horn which imparts directivity to the ultrasonic wave and a bent wave guide which connects the ultrasonic vibrator and the horn, and a reflecting plate which is provided in the bent portion of the wave guide for guiding the ultrasonic wave into the horn or the ultrasonic vibrator. According to the ultrasonic transducer of the present invention, the ultrasonic vibrator can be positioned above the horn when the horn is horizontally disposed. Therefore, the ultrasonic vibrator is not splashed with water entering from the horn.

4 Claims, 4 Drawing Figures

ULTRASONIC TRANSDUCER

BACKGROUND OF THE INVENTION

The present invention relates to an ultrasonic transducer which transmits and receives ultrasonic wave, especially to an ultrasonic transducer for detecting an object such as an obstacle.

The ultrasonic transducer generally comprises an ultrasonic vibrator 1 for transmitting and receiving ultrasonic wave, a horn 2 and a wave guide 3 for connecting the ultrasonic vibrator 1 and the horn 2 as shown in FIG. 1. The ultrasonic vibrator 1 is conventionally disposed coaxially with the horn 2. When the conventional ultrasonic transducer having the above described construction is horizontally attached to the outer portion of a rear end of a motor vehicle for detecting an obstacle backward of the vehicle, for example, the ultrasonic vibrator 1 is directly splashed with rain water or vehicle washing water which enters through the horn 2. And the water droplets adhered to the ultrasonic vibrator 1 are not easily removed. Consequently, the transmitting and receiving sensitivity of the ultrasonic vibrator 1 becomes lower and the life of the ultrasonic vibrator 1 is decreased due to the corrision thereof.

One object of the present invention is to provide an ultrasonic transducer which is suited to be disposed in a place exposed to rain water or the like.

Another object of the present invention is to provide an ultrasonic transducer having such a construction that the ultrasonic vibrator thereof is not splashed with water such as rain water and vehicle washing water which enters into the horn or the wave guide.

DESCRIPTION OF THE DRAWINGS

Other objects and advantages of the present invention will become apparent from the following description of embodiments with reference to the accompanying drawings wherein:

FIG. 2 is a sectional view of a first embodiment of the present invention;

FIG. 3 is a sectional view of a second embodiment of the present invention; and FIG. 4 is a sectional view of a third embodiment of the present invention.

SUMMARY OF THE INVENTION

In the ultrasonic transducer of the present invention, a wave guide is bent in the axially central portion thereof and within one end of the wave guide, an ultrasonic vibrator is retained while the other end thereof is connected to a horn.

In the bent portion of the wave guide, a reflecting plate for reflecting the ultrasonic wave transmitted from the vibrator in the direction along the horn and reflecting the ultrasonic wave entering from the horn in the direction of the vibrator, is provided.

Therefore, by the ultrasonic transducer of the present invention, the vibrator can be positioned in the place higher than the horn when the horn is horizontally disposed so that the ultrasonic vibrator can be prevented from being splashed with water entering the horn.

DETAILED DESCRIPTION OF THE INVENTION

Hereinafter, the present invention will be explained in detail according to the several embodiments with reference to the accompanying drawings.

Figure 1:
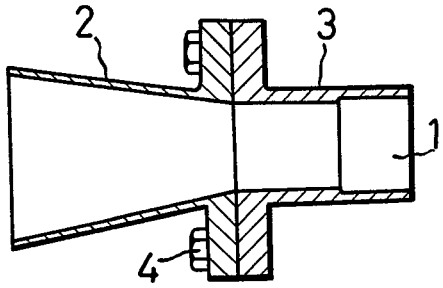
FIG. 1 is a sectional view of a conventional ultrasonic transducer.
Figure 2:
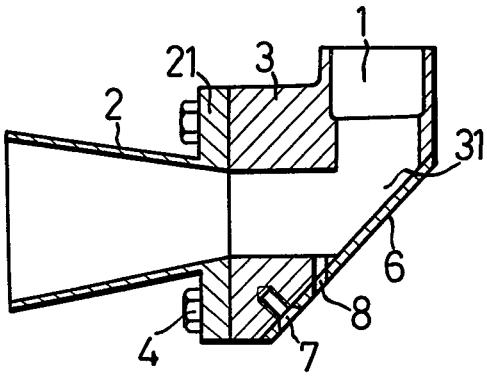
FIG. 2 to FIG. 4 are sectional views of ultrasonic transducers of the present invention.

In a first embodiment shown in FIG. 2, a cylindrical ultrasonic vibrator 1 is retained within one end of a cylindrical wave guide 3. The other end of the wave guide 3 is connected to a conical horn 2 having a predetermined directivity, in a flange 21 which is formed in the outer periphery of a throat of the horn 2, by means of bolts 4.

The wave guide 3 on the side of the vibrator 1 extends coaxially with the vibrator 1 and the wave guide 3 on the side of the horn 2 extends coaxially with the horn 2. The axially central portion of the wave guide 3 is bent at a right angle. This bent portion of the wave guide 3 is provided with an opening 31 on the projecting side thereof. And a flat plate-shaped reflecting plate 6 is fixed to the opening 31 by means of screws 7.

On the reflecting surface of the reflecting plate 6. the central axis of the ultrasonic vibrator 1 intersects with that of the horn 2 at right angles. And the reflecting plate 6 is disposed so that the angle between the reflecting surface thereof and each central axis is 45°.

And a weep hole 8 is provided in the bottom portion of the wave guide 3. The reflecting plate 6 is made of metal or the material having good sound reflecting property.

When electrical signal having a predetermined frequency is applied to the ultrasonic vibrator 1 of the ultrasonic transducer having the above described construction, ultrasonic wave is generated in the ultrasonic vibrator 1 and is transmitted along the wave guide 3 to the reflecting plate 6.

After being reflected by the reflecting plate 6, the ultrasonic wave is transmitted through the wave guide 3 and the horn 2 in the direction parallel with the central axis thereof. Then, the ultrasonic wave is transmitted to a monitoring area.

An ultrasonic signal reflected from an obstacle positioned in the monitoring area, reaces the ultrasonic vibrator 1 through the horn 2, the wave guide 3, and the reflecting plate 6 and is converted into an electrical signal by the ultrasonic vibrator 1.

When the ultrasonic transducer of the present invention is used as an obstacle detecting means of a motor vehicle, the ultrasonic transducer is attached to the bottom surface of the rear end of the vehicle so that the horn 2 is directed backward and disposed horizontally.

In this case, the ultrasonic vibrator 1 is hardly splashed with rain water or vehicle washing water entering from the opening of the horn 2, since the ultrasonic vibrator 1 is positioned in the place higher than the horn 2.

And since the ultrasonic vibrator 1 is vertically disposed so that the end surface thereof is directed downward, even if water droplets are adhered to the ultrasonic vibrator 1, they are easily dropped therefrom. And the water entering the horn 2 and the wave guide 3 is immediately discharged from the weep hole 8.

Figure 3:
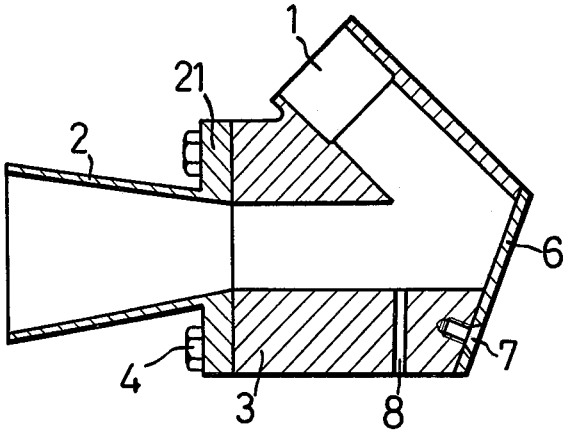

FIG. 3 shows a second embodiment of the present invention.

In the ultrasonic transducer of the second embodiment, the wave guide 3 is bent at an acute angle and the ultrasonic vibrator 1 and the horn 2 are arranged so that the central axes thereof are intersected at acute angles.

The reflecting plate 6 is disposed so that the central axes of the ultrasonic vibrator 1 and the horn 2 are intersected on the reflecting surface thereof and that the angle between the central axis of the ultrasonic vibrator 1 and the reflecting surface thereof becomes equal to that between the central axis of the horn 2 and the reflecting surface thereof.

Other construction of the second embodiment is substantially the same as that of the first embodiment.

According to the third embodiment of the ultrasonic transducer having the above-described construction, the focal point of the reflecting plate is at the center of the vibrator 1 so that all of the ultrasonic waves can be effectively received by the ultrasonic vibrator 1. All of the ultrasonic waves reflected by the reflecting plate 6 toward the horn 2 extend parallel with one another so that the horn effectively imparts directivity to the ultrasonic waves.

According to the ultrasonic transducer of the second embodiment, the ultrasonic vibrator is less splashed with water compared with that of the first embodiment.

Figure 4:
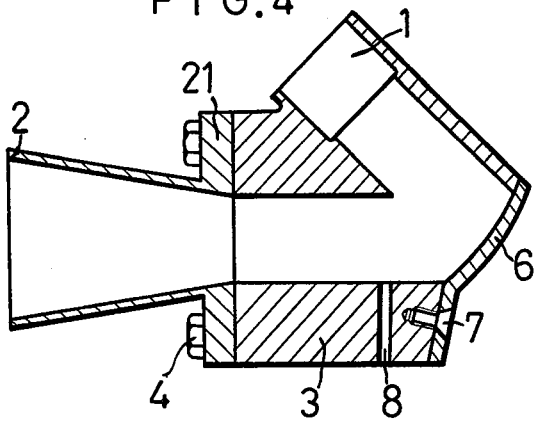

FIG. 4 shows a third embodiment of the present invention.

In the ultrasonic transducer of the third embodiment, the reflecting plate 6 is formed into a paraboloid, and the ultrasonic vibrator 1 is disposed so that the focal point of the paraboloid of the reflecting plate 6 is positioned at the center of the lower end surface of the ultrasonic vibrator 1.

Other construction of the third embodiment is substantially equal to that of the second embodiment. The operation and the effect of the third embodiment are also similar to those of the second embodiment.

As described in the above three embodiments, the present invention provides an ultrasonic transducer comprising an ultrasonic vibrator and a horn which are arranged so that the central axes thereof are intersected with each other within a wave guide at predetermined angles, and a reflecting plate which is disposed so that the central axes of the ultrasonic vibrator and the horn are intersected thereon.

By the ultrasonic transducer of the present invention, even if water such as rain water enters from the horn, the ultrasonic vibrator is not splashed with the water.

Therefore, the transmitting and receiving sensitivity of the ultrasonic vibrator can be prevented from being lowered and the life of the ultrasonic vibrator can be made long.

Having now fully described the invention, it will be apparent to one of ordinary skill in the art that many changes and modifications can be made thereto without departing from the spirit or scope of the invention as set forth herein.

What is claimed is:

1. An ultrasonic transducer comprising:

an ultrasonic vibrator having a cylindrical body for transmitting and receiving ultrasonic waves;

a cylindrical horn for imparting directivity to said ultrasonic waves;

a cylindrical wave guide connecting said vibrator and said horn, said guide being bent so that said vibrator is positioned above said horn;

a reflecting plate having a paraboloidal reflecting surface exposed within the bent portion of said guide for reflecting said ultrasonic waves passing therethrough;

one end of said wave guide being coaxially connected to said horn and the other end to said vibrator;

the central axis of said wave guide coaxially aligned with said vibrator intersecting the central axis of said guide coaxially aligned with said horn on said paraboloidal reflecting surface; and said vibrator being positioned at the focal point of said paraboloidal reflecting surface.

2. An ultrasonic transducer according to claim 1, wherein:

said wave guide is provided with an opening in the bent portion thereof; and said reflecting plate is closely inserted within said opening so as to form one portion of said wave guide.

3. An ultrasonic transducer according to claim 1, wherein:

said wave guide is provided in the bottom portion there of with a weep hole for discharging water entering said wave guide.

4. An ultrasonic transducer according to claim 1, wherein:

said wave guide is bent at an acute angle.

* * * * *